United States Patent [19]

Weick

[11] Patent Number: 4,978,022

[45] Date of Patent: Dec. 18, 1990

[54] PIGGYBACK MICROWAVE CONTAINER

[75] Inventor: Robert D. Weick, Spring Lake, Mich.

[73] Assignee: Gerber Products Company, Fremont, Mich.

[21] Appl. No.: 464,951

[22] Filed: Jan. 16, 1990

[51] Int. Cl.[5] ..... B65D 25/08

[52] U.S. Cl. ..... 220/23; 220/23.83; 220/23.86; 220/258; 206/501; 206/219; 219/10.55 E

[58] Field of Search ..... 220/22, 23, 23.83, 23.86, 220/380, 266, 258, 55, 256; 206/501, 502, 219; 219/10.55 E

[56] References Cited

U.S. PATENT DOCUMENTS

| | | | |
|---|---|---|---|
| 2,240,602 | 5/1941 | Bartsch . | |
| 2,326,414 | 8/1943 | Thompson . | |
| 2,514,573 | 7/1950 | Harrison . | |
| 2,695,115 | 11/1954 | Roop | 220/355 |
| 2,899,096 | 8/1959 | Henchert et al. . | |
| 3,720,524 | 3/1973 | Nakagami . | |
| 3,779,372 | 12/1973 | de Lloret | 220/20 X |
| 3,954,178 | 5/1976 | Mason, Jr. | 206/508 |
| 3,967,731 | 7/1976 | Boduch | 206/508 |
| 4,091,953 | 5/1978 | Daenen | 220/23.86 |
| 4,234,097 | 11/1980 | Daenen | 220/4 D |
| 4,248,901 | 2/1981 | Austin . | |
| 4,311,238 | 1/1982 | Smith | 206/508 |
| 4,333,581 | 6/1982 | Flansburg | 220/20 |
| 4,348,421 | 9/1982 | Sakakibara et al. | 206/219 X |
| 4,373,633 | 2/1983 | Lutz, Sr. | 206/508 |
| 4,386,109 | 5/1983 | Bowen et al. | 219/10.55 E |
| 4,491,219 | 1/1985 | Lutz | 220/23.86 |
| 4,548,348 | 10/1955 | Clements . | |
| 4,574,174 | 3/1986 | McGonigle | 219/10.55 M |
| 4,711,356 | 12/1987 | Dunden . | |
| 4,756,446 | 7/1988 | Gen et al. | 220/410 |
| 4,807,776 | 2/1989 | Cortopassi | 220/23.83 |
| 4,883,935 | 11/1989 | Fairchild | 219/10.55 E |

FOREIGN PATENT DOCUMENTS

| | | | |
|---|---|---|---|
| 2206276 | 1/1989 | United Kingdom | 220/23.86 |
| 2218962 | 11/1989 | United Kingdom | 220/23.86 |

*Primary Examiner*—William I. Price

*Attorney, Agent, or Firm*—Price, Heneveld, Cooper, DeWitt & Litton

[57] ABSTRACT

A piggyback food container having a polymeric bowl forming a first food compartment and a removable cover thereover, a polymeric overcap on said bowl forming a central second food compartment and a peripheral wall, a breakaway juncture between this central compartment and the peripheral wall, enabling the wall to add volume capacity to the uncovered bowl.

22 Claims, 2 Drawing Sheets

PIGGYBACK MICROWAVE CONTAINER

BACKGROUND OF THE INVENTION

This invention relates to a food container, and more particularly to a so-called piggyback type microwave container for separated food components to be mixed together prior to use In general, piggyback containers capable of enabling separate food processing of the components and retention of the separated food components in individual compartments for ultimate mixing thereof are known in the art. In U.S. patent application Ser. No. 228,623, filed Aug. 4, 1988, U.S. Pat. No. 4,883,955 and entitled A SEPARABLE RECOMBINABLE MULTI-PART CONTAINER WITH SEPARATELY SEALED CHAMBERS, is disclosed a container wherein the separate food components are ultimately mixed together in the lower compartment just prior to use, the upper container serving as an overcap to close the lower container. That multi-part container included a special seam ring which projects upwardly around the periphery of the lower compartment so as to increase the volume capacity thereof for ease of mixing components. Increasing the volume capacity of the lower compartment is particularly advantageous to enable easy, rapid mixing of the two food components together therein, and subsequent processing such as heating in a microwave oven.

SUMMARY OF THE INVENTION

The present invention provides a multi-part or so-called piggyback container which not only allows separate pretreatment and separate storage of two food components, but also provides a unique breakaway feature in the upper container component, achieving greatly increased volume capacity for convenient mixing of the food components and processing thereof as by microwave heating, yet no separate seam ring need be employed just prior to use.

The unique container enables shipping, handling and display of the product components in the separate compartments, followed by consumer separation of the container compartments and food components for unsealing and mixing thereof This involves separation of the upper food compartment from the lower one for unsealing the lower compartment, and breakaway of the central part of the upper food compartment from its peripheral outer wall such that this outer wall can be retained in engagement with the lower compartment to greatly increase the volume capacity thereof for most convenient mixing, and for processing of the mixed components as in a microwave.

The multi-part container is capable of mass production so as to minimize cost. No added seam ring is required. The various parts of the container can be fabricated of known materials such as moldable polymers. The container is simple to use, yet effecting substantially increased volume capacity for ease of mixing and treatment.

These and several other objects, advantages and features of this invention will become apparent to those in the art upon studying the following detailed description in conjunction with the drawings.

DESCRIPTION OF THE PREFERRED EMBODIMENT

Figure 1:
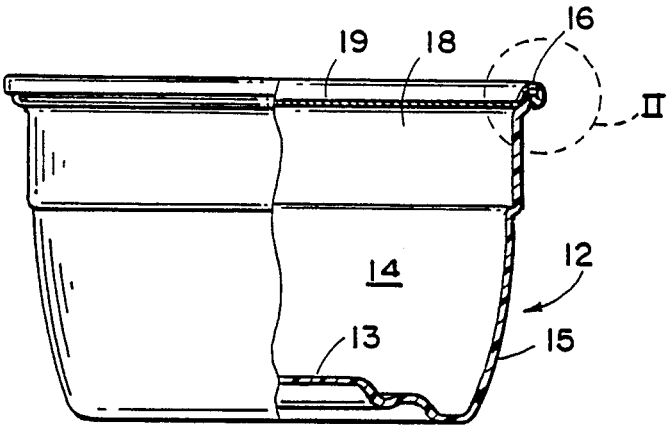
FIG. 1 is a side elevational partially sectioned view of the lower member of the multi-part container.
Figure 2:
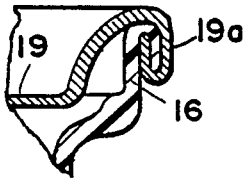
FIG. 2 is an enlarged fragmentary sectional view of portion II of the peripheral seam of the lower member and its cover in FIG. 1.
Figure 3:
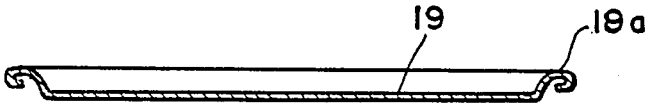
FIG. 3 is a sectional elevational view of the cover for the member in FIG. 1.
Figure 4:
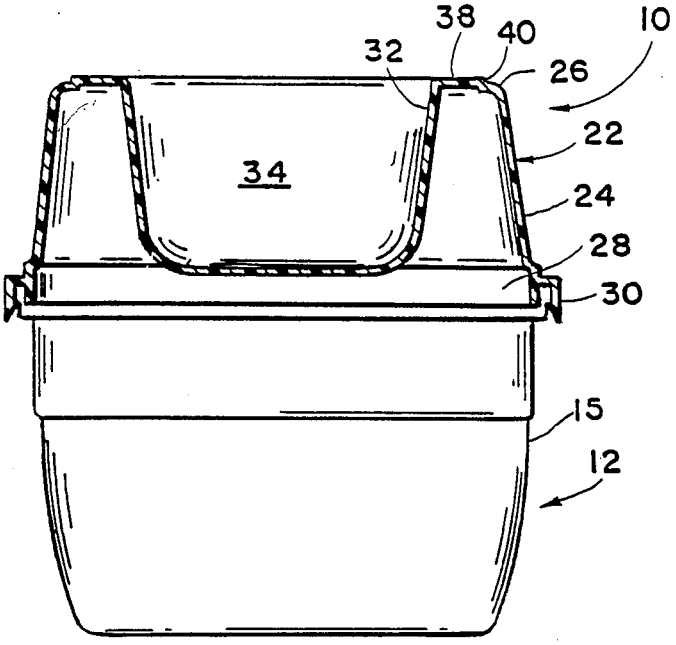
FIG. 4 is an elevational view of the completed container, showing the upper member in section.
Figure 5:
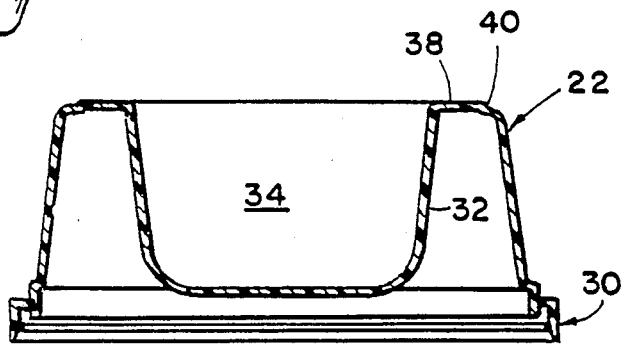
FIG. 5 is a sectional elevational view of the upper member.
Figure 6:
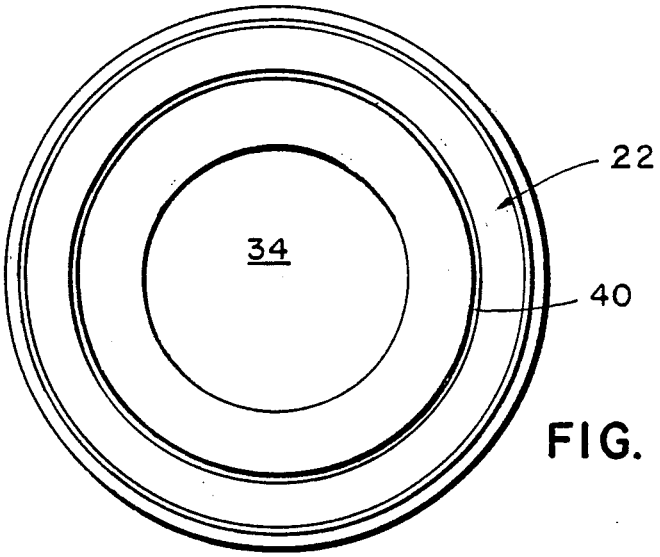
FIG. 6 is a top plan view of the upper member.

Referring now to the drawings, the complete container 10 (FIG. 4) comprises a lower bowl member 12 and an upper overcap member 22, each of which initially retains one of the food components in a manner to be described hereinafter. Lower bowl 12 includes a bottom 13 and an integrally joined peripheral upstanding wall 15 terminating in an upper rim 16 which projects upwardly and outwardly. This bowl forms a compartment 14 for a first food component such as a food component which requires high temperature processing as in an autoclave. This container has an open top 18 (FIG. 1) which is closed after filling and prior to shipment by a cover or lid 19 of conventional thin metal e.g. aluminum, or paper stock for easy removal by a consumer. This cover includes a peripheral seam portion 19*a* interengaged with peripheral rim 16 of bowl 12, as shown in FIG. 2, wherein the cover and rim are rolled into mutual engagement with each other.

Typically, the lower container with its contents and its cover in place will be subjected to a thermal processing operation such as autoclaving. The lower member may be molded of a polymer such as polypropylene.

Figure 8:
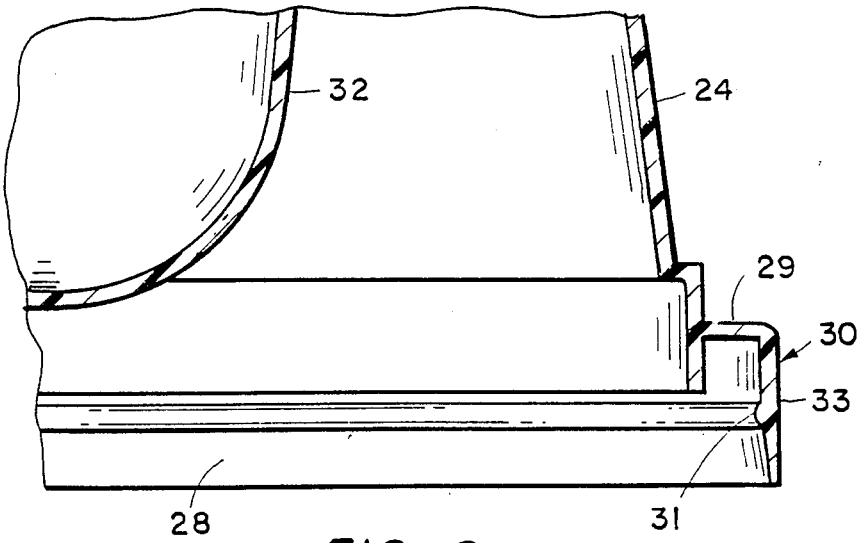
FIG. 8 is an enlarged fragmentary sectional view of another portion of the upper member.

The upper overcap member 22 is also of a polymeric material such as high density polyethylene It includes a peripheral outer wall 24 which has at its lower end connecting means 30 for sealingly engaging with the rim of bowl 12. This connecting means is a resilient, flexible sealing connector shown as an inverted U-shaped component 29 (FIG. 8) with an annular inwardly facing snap rib 31 on the outer leg of the U, to engage around and beneath the periphery of rim 16 which forms the cooperative connecting means. In the event that cover 19 of bowl 12 is of metallic material, the depending outer skirt 33 of this U-shaped component 30 on upper member 22 also serves to cover any metal retained on the rim when the bowl is opened, so that the metal will not interfere with microwave heating to be conducted on the mixed food components.

Figure 7:
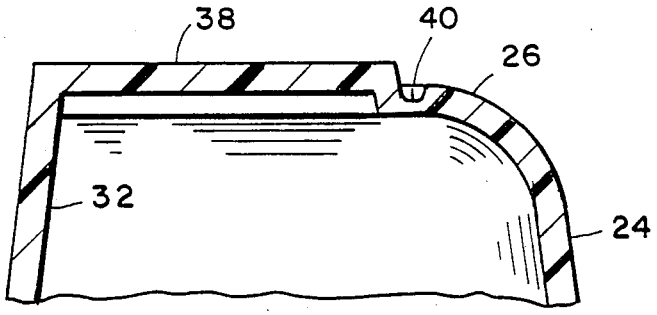
FIG. 7 is an enlarged sectional view of a portion of the upper member showing the breakaway juncture in detail.

Overcap 22 includes a central depression formed by a depending peripheral wall 32 integrally formed with a bottom 33 to define chamber 34 for a second food component. This upper compartment has an upper rim 38. This central depression compartment 34 will have a sealed cover thereover as of thin metallic or paper material adhered to rim 38 to seal the second food component therein. Peripheral wall 24 is shown to have an annular top 26 thereon. Between annular rim 38 and annular top 26 is a frangible annular ring juncture 40 made to have a breakaway characteristic. Specifically, referring to FIG. 7, this juncture 40 is of less thickness of polymeric material to allow fracture along this juncture for breakaway of the central portion of component 22 from the outer peripheral wall 24 thereof, by downward manual force of a predetermined amount. In the preferred embodiment depicted, the polymeric components, as noted, are of high density polyethylene such as the material designated 52053N from Dow Chemical Company, Midland, Mich., capable of being molded into the members set forth. In the preferred embodiment, the thickness of juncture 40 is approximately 0.010 inch as compared to a thickness of the adjacent portions of approximately 0.025 inch. Thus, the preferred thickness of the breakaway juncture is less than one-half that of the adjacent material. Further, the adjacent material has added strength and rigidity due to the convexly curved peripheral wall on the outer periphery of the juncture, and the vertical offset in the rim on the inner periphery thereof. This vertical offset not only adds strength and rigidity but also raises the rim sufficiently to enable manual force to be readily applied thereto. The horizontal 1 orientation of the juncture allows vertical force applied down on the rim to subject the juncture to shear, for breakage, thereby separating the central portion of the upper member from the peripheral wall portion thereof. This separation creates an opening where the central portion was located. The bottom of upper member 22 is open at 28, i.e., within the confines of connection 30 and beneath the central portion. Thus, when the central portion is removed, the structure is open from the top of wall 24 to the lower compartment 14.

Breakaway of the central portion of member 22 ca be achieved either while upper and lower components 22 and 12 are still connected with each other or, if desired, after upper component 22 is separated from lower component 12 by disengaging the peripheral connecting means 30 and 16. If the breakaway function is achieved after the two are separated, then, prior to mixing the second food component with the first one, peripheral wall portion 24 of upper container 22 is again reattached to lower container 12. After breakaway of the center portion of component 22, the cover or lid is removed from the upper container and the contents thereof poured through the new opening remaining at juncture 40 and down into compartment 14.

In use, the food manufacturer fills lower bowl compartment 12 with a first food component through open top 18 of the bowl, places cover 19 thereover, secures it at its periphery with an adhesive heat seal or a conventional seaming process, and subjects the food to any desired processing such as thermal autoclaving. A separate food component is placed in compartment 34, typically a food which does not require the high temperature processing operation, with the open top of compartment 34 then being closed by a sealing cover (not shown) adhered to rim 38. Upper member 22 is then peripherally attached to lower member 12 by engaging the connecting means 16/30 therebetween. The separated product is then shipped as a unit package to the retailer where it is displayed in like fashion.

Upon purchase of the item by a consumer, upper member 22 is separated from lower member 12, cover 19 is removed from lower member 12 to open lower compartment 14 at 18, breakaway juncture 40 is disjointed by applying manual force to the central part of member 22, with or without the peripheral wall 24 attached to the lower container, the cover is removed from the upper compartment 34, and the contents of compartment 34 are poured into the opening left by the breakaway at 40, to mix such with the contents of lower compartment 14. The peripheral wall 24 above lower container 12 adds considerable increased volume capacity so that mixing of the two components can be readily achieved without spilling Further, the mixed components can then be subjected to microwave heating or the like without spillage.

Certain additional features not specifically cited may appear to those in this art upon studying this disclosure. In addition, certain details of construction could be modified without departure from the concept presented. Hence, the invention is intended to be limited not to the specific preferred illustrative embodiment set forth, but only by the scope of the appended claims and the reasonable equivalent structures to that set forth therein.

The embodiments of the invention in which an exclusive property or privilege is claimed are defined as follows.

1. A food container comprising:

a bowl forming a first receptacle for a first food component;

said bowl having an open top;

a removable closure over said open top;

upper peripheral connector means on said bowl for engaging an overcap;

an overcap on said bowl over the top of said bowl;

said overcap having an upstanding peripheral wall and a top integral with said wall;

said overcap having an open bottom;

lower peripheral connector means on said overcap for engaging said upper peripheral connector means;

said top of said overcap having a central depression including a depending peripheral wall forming a second compartment for a second food component and surrounded by an upper rim;

a frangible annular breakaway juncture between said depression and said peripheral wall of said overcap, enabling forceful breakaway alorg said juncture to separate said second compartment from said upstanding peripheral wall of said overcap, leaving an opening in said overcap whereby the second food component can be poured from said second compartment through said overcap into said first compartment to combine such with the first food component while said upstanding peripheral wall connected to said bowl adds volume capacity thereto.

2. The food container in claim 1 including a seal cover over said depression sealed to said rim radially within said frangible ring juncture to maintain said second food component sealed until removed.

3. The food container in claim 1 wherein said bowl and said overcap are of polymeric material, and said overcap has areas of rigidity adjacent said juncture.

4. The food container in claim 3 wherein said areas of rigidity are annular, and are located inside and outside of said juncture.

5. The food container in claim 3 wherein said juncture is of lesser thickness than said areas of rigidity.

6. The food container in claim 5 wherein said juncture has a thickness less than one-half that of said areas of rigidity.

7. The food container in claim 6 wherein said polymeric material is high density polyethylene.

8. A food container comprising;

a bowl member forming a first compartment for a first food component;

said bowl member having an openable top and upper peripheral connector means for engaging an overcap member;

an overcap member extending over said top of said bowl, having an upstanding peripheral wall, a center portion, and having an open bottom;

lower peripheral connector means on said overcap member for engaging said upper peripheral connector means of said bowl member;

a frangible annular ring juncture adjacent said overcap peripheral wall enabling forceful breakaway of the center of said overcap member from said overcap peripheral wall, leaving an opening in said top of said overcap to said bowl.

9. The food container in claim 8 wherein;

said overcap center portion has a depression forming a second compartment for a second food component.

10. The food container in claim 9 wherein;

said lower connector means is temporarily separable from said upper connector means for separation of said overcap from said bowl to enable removal of said cover from said bowl and is re-engageable with said upper connector means to enable said overcap peripheral wall to enlarge the volume capacity of said lower bowl member.

11. The food container in claim 9 wherein said bowl member and said overcap are of polymeric material, and said overcap has annular areas of rigidity adjacent said juncture.

12. The food container in claim 11 wherein said juncture has less thickness than said areas of rigidity.

13. A food container comprising:

a bowl forming a first receptacle for a first food component;

said bowl having an open top;

a removable closure over said open top;

upper peripheral connector means on said bowl for engaging an overcap;

an overcap on said bowl over the top of said bowl;

said overcap having an upstanding peripheral wall and a top integral with said wall;

said overcap having an open bottom;

lower peripheral connector means on said overcap for engaging said upper peripheral connector means;

said top of said overcap having a central depression including a depending peripheral wall forming a second compartment for a second food component and surrounded by an upper rim;

releasable securing means between said second compartment and said upstanding peripheral wall of said overcap for releasably securing said second compartment to said upstanding peripheral wall, and upon release thereof to separate said second compartment from said upstanding peripheral wall of said overcap, leaving an opening in said overcap whereby the second food component can be poured from said second compartment through said overcap into said first compartment to combine such with the first food component while said upstanding peripheral wall connected to said bowl adds volume capacity thereto.

14. The food container in claim 13 wherein said releasable securing means is a frangible juncture.

15. The food container in claim 13 including a seal cover over said depression sealed to said rim radially within said releasable securing means to maintain said second food compartment sealed until removed.

16. The food container in claim 14 wherein said bowl and said overcap are of polymeric material, and said overcap has areas of rigidity adjacent said juncture.

17. The food container in claim 14 wherein said areas of rigidity are annular, and are located inside and outside of said juncture.

18. The food container in claim 16 wherein said juncture is of lesser thickness than said areas of rigidity.

19. The food container in claim 18 wherein said juncture has a thickness less than one-half that of said areas of rigidity.

20. The food container in claim 13 wherein:

said lower connector means is temporarily separable from said upper connector means for separation of said overcap from said bowl to enable removal of said cover from said bowl and is re-engageable with said upper connector means to enable said overcap peripheral wall to enlarge the volume capacity of said lower bowl member.

21. The food container in claim 14 wherein said bowl member and said overcap are of polymeric material, and said overcap has annular areas of rigidity adjacent said 22. The food container in claim 21 wherein said juncture has less thickness than said areas of rigidity.

* * * * *

UNITED STATES PATENT AND TRADEMARK OFFICE

CERTIFICATE OF CORRECTION

PATENT NO. : 4,978,022

DATED : December 18, 1990

INVENTOR(S) : Robert D. Weick

It is certified that error appears in the above-identified patent and that said Letters Patent is hereby corrected as shown below:

Column 1, line 9;
After "use" insert -- . --;

Column 1, line 15;
"4,883,955" should be -- 4,883,935 --;

Column 1, line 48;
After "thereof" insert -- . --;

Column 2, line 46;
After "polyethylene" insert -- . --;

Column 3, line 25;
After "horizontal" delete -- 1 --;

UNITED STATES PATENT AND TRADEMARK OFFICE

CERTIFICATE OF CORRECTION

PATENT NO. : 4,978,022

DATED : December 18, 1990

INVENTOR(S) : Robert D. Weick

It is certified that error appears in the above-identified patent and that said Letters Patent is hereby corrected as shown below:

Column 3, line 36;
"22 ca" should be -- 22 can --;

Column 4, line 10;
After "spilling" insert -- . --;

Column 4, line 45;
"alorg" should be -- along --;

Column 6, line 49;
After "said" insert -- juncture --.

Signed and Sealed this

Twenty-sixth Day of May, 1992

*Attest:*

DOUGLAS B. COMER

*Attesting Officer*

*Acting Commissioner of Patents and Trademarks*